US008468635B2

(12) United States Patent
Nikitczuk et al.

(10) Patent No.: US 8,468,635 B2
(45) Date of Patent: Jun. 25, 2013

(54) SURFACE TREATING DEVICE

(75) Inventors: Jason J. Nikitczuk, Belle Mead, NJ (US); Christopher Miller, Astoria, NY (US); Matthew L. Phillips, Litchfield, CT (US); Benny S. Yam, Holmdel, NJ (US); Bernadette Devaney, Jackson, NJ (US); Paul Dowd, Scarsdale, NY (US)

(73) Assignee: Church & Dwight Co., Inc., Princeton, NJ (US)

( * ) Notice: Subject to any disclaimer, the term of this patent is extended or adjusted under 35 U.S.C. 154(b) by 727 days.

(21) Appl. No.: 12/625,731

(22) Filed: Nov. 25, 2009

(65) Prior Publication Data

US 2011/0119843 A1 May 26, 2011

(51) Int. Cl.
*A46B 13/04* (2006.01)

(52) U.S. Cl.
USPC ..... 15/22.2; 15/22.1; 15/50.2

(58) Field of Classification Search
USPC ..... 15/22.1, 22.2, 50.2, 52.2
See application file for complete search history.

(56) References Cited

U.S. PATENT DOCUMENTS

| | | | |
|---|---|---|---|
| 1,925,350 | A | 9/1933 | Tucker |
| 2,825,925 | A | 3/1958 | Acheson |
| 2,858,560 | A | 11/1958 | Bodine |
| D186,102 | S | 9/1959 | Semeraro |
| 2,975,448 | A | 3/1961 | Glaser |
| 3,276,066 | A | 10/1966 | Chiba |
| D207,632 | S | 5/1967 | Anderson |
| 3,615,819 | A | 10/1971 | Cauley |
| 3,615,820 | A | 10/1971 | Herrick |
| 3,641,612 | A | 2/1972 | Clurman et al. |
| 3,690,524 | A | 9/1972 | Haberhauer |
| 3,711,891 | A | 1/1973 | Conway |
| 3,739,417 | A | 6/1973 | Sawyer |
| 3,765,144 | A | 10/1973 | Schiesser |
| 3,894,381 | A | 7/1975 | Christine et al. |
| 4,069,541 | A | 1/1978 | Williams et al. |
| 4,076,147 | A | 2/1978 | Schmit |
| 4,126,167 | A | 11/1978 | Smith et al. |
| 4,165,023 | A | 8/1979 | Schmit |
| 4,353,488 | A | 10/1982 | Schneiter et al. |
| 4,408,366 | A | 10/1983 | Goldsmith |
| 4,433,451 | A | 2/1984 | Parisi |
| 4,445,539 | A | 5/1984 | Credle |

(Continued)

FOREIGN PATENT DOCUMENTS

| | | |
|---|---|---|
| DE | 196 17 024 | 3/1998 |
| EP | 0 498 117 | 8/1992 |

(Continued)

OTHER PUBLICATIONS

Bissell Homecare, Inc., "SpotBot User's Guide", pp. 1-16, Date unknown.

*Primary Examiner* — Randall Chin
(74) *Attorney, Agent, or Firm* — Allen R. Kipnes; Stephen B. Shear

(57) ABSTRACT

A surface treating device includes a member adapted for engaging a surface to be treated and a driver operatively associated with the member. The driver is adapted for imparting a linear reciprocating motion to the member, wherein the member engages the surface in a manner substantially perpendicular to the surface to be treated. The surface treating device further includes a dispenser for delivering a fluid drawn from a discrete fluid source to the surface being treated by the member.

32 Claims, 9 Drawing Sheets

U.S. PATENT DOCUMENTS 4,514,742 A 4/1985 Suga et al.
4,529,108 A 7/1985 Chlystun
4,561,110 A 12/1985 Herbert
4,619,797 A 10/1986 Chlystun
4,765,012 A 8/1988 Ueda
4,784,654 A 11/1988 Beecher
4,802,782 A 2/1989 Scalf
4,813,578 A 3/1989 Gordon et al.
4,863,629 A 9/1989 Osberghaus et al.
4,882,596 A 11/1989 Tsuzuki et al.
D306,657 S 3/1990 Fushiya et al.
4,909,434 A 3/1990 Jones et al.
4,993,594 A 2/1991 Becker et al.
5,004,123 A 4/1991 Stoody
5,076,954 A 12/1991 Loth et al.
5,118,436 A 6/1992 Aoyagi et al.
5,139,168 A 8/1992 Gueret
5,147,467 A 9/1992 Virtue
5,152,431 A 10/1992 Gardner et al.
5,152,461 A 10/1992 Proctor
5,156,299 A 10/1992 De Caluwe et al.
5,171,439 A 12/1992 Vakharia
5,178,021 A 1/1993 Kosuth
5,252,243 A 10/1993 Minns
5,257,865 A 11/1993 Tani
5,263,218 A * 11/1993 Giuliani et al. ..... 15/22.1
5,290,472 A 3/1994 Michael
5,332,157 A 7/1994 Proctor
5,338,475 A 8/1994 Corey et al.
5,348,556 A 9/1994 Minns et al.
5,353,836 A 10/1994 deCler et al.
5,385,270 A 1/1995 Cataneo et al.
5,389,278 A 2/1995 Minns et al.
5,402,916 A 4/1995 Nottingham et al.
5,423,102 A 6/1995 Madison
5,429,699 A 7/1995 Abrams et al.
5,433,350 A 7/1995 Graubart
5,467,581 A 11/1995 Everette
5,471,695 A 12/1995 Aiyar
5,472,119 A 12/1995 Park et al.
5,474,212 A 12/1995 Ichikawa et al.
5,477,883 A 12/1995 Totten
5,492,540 A 2/1996 Leifheit et al.
5,522,580 A 6/1996 Varner et al.
5,538,664 A 7/1996 Michael
5,560,545 A 10/1996 Grogan et al.
5,562,250 A 10/1996 O'Neill
5,568,883 A 10/1996 Cataneo et al.
5,580,495 A 12/1996 Young
5,617,603 A 4/1997 Mei
5,626,259 A 5/1997 Maas et al.
5,634,571 A 6/1997 Cataneo et al.
5,647,511 A 7/1997 Bond
5,690,764 A 11/1997 Dirksing et al.
5,711,457 A 1/1998 Wanbaugh et al.
5,716,471 A 2/1998 Pape
5,728,669 A 3/1998 Tyerech
5,736,498 A 4/1998 Gray
5,743,435 A 4/1998 Tomic
5,749,924 A 5/1998 Murch et al.
5,769,274 A 6/1998 Behar
5,823,383 A 10/1998 Hins
5,827,164 A 10/1998 Tomic
5,849,039 A 12/1998 Sadlowski
5,851,072 A 12/1998 LaFleur
5,863,499 A 1/1999 Kralovic
5,873,491 A 2/1999 Garcia et al.
5,879,470 A 3/1999 Murch et al.
5,911,340 A 6/1999 Uematsu
5,942,484 A 8/1999 Roetker et al.
5,947,335 A 9/1999 Milio et al.
5,972,090 A 10/1999 Horth
5,979,707 A 11/1999 Bodin et al.
6,000,788 A 12/1999 Iida
6,000,848 A 12/1999 Massioui
6,008,175 A 12/1999 Scialla et al.
6,037,317 A 3/2000 Rapisarda et al.
6,043,209 A 3/2000 Micciche et al.
6,045,006 A 4/2000 Frazier et al.
6,050,451 A 4/2000 Hess et al.
6,066,081 A 5/2000 Bachner
6,088,873 A 7/2000 Pacchini et al.
6,099,587 A 8/2000 Scialla et al.
6,102,252 A 8/2000 Overman et al.
6,106,774 A 8/2000 Monticello et al.
6,113,654 A 9/2000 Peterson
6,170,939 B1 1/2001 Ujita et al.
6,177,395 B1 1/2001 Silvaggi et al.
6,233,771 B1 5/2001 Hortel et al.
6,273,307 B1 8/2001 Gross et al.
6,276,788 B1 8/2001 Hilton
6,403,547 B1 6/2002 Grippaudo et al.
6,472,360 B1 10/2002 Beggs et al.
6,531,437 B1 3/2003 Ryan et al.
6,550,694 B1 4/2003 Foster et al.
6,554,412 B1 4/2003 Seino et al.
6,560,806 B1 5/2003 Lawson et al.
6,561,386 B1 5/2003 Martens
6,578,224 B1 6/2003 Lawson et al.
6,589,294 B2 7/2003 Hortel et al.
6,612,466 B1 9/2003 Malin
6,612,690 B1 9/2003 Wallace et al.
6,668,420 B2 12/2003 Hannan et al.
6,715,644 B2 4/2004 Wilford
6,719,415 B1 4/2004 Hattori et al.
6,729,560 B2 5/2004 Foster et al.
6,769,573 B1 8/2004 Kazarian et al.
6,772,966 B2 8/2004 Foster et al.
6,831,050 B2 12/2004 Murch et al.
6,838,424 B2 1/2005 Ozaki et al.
6,841,090 B1 1/2005 Allighieri et al.
6,843,390 B1 1/2005 Bristor
6,846,332 B2 1/2005 Boissie et al.
6,850,406 B2 2/2005 Asami et al.
6,851,579 B2 2/2005 Savage et al.
6,859,976 B2 3/2005 Plankenhorn
6,860,406 B2 3/2005 Kobetsky et al.
6,874,876 B2 4/2005 Ishizawa et al.
6,883,989 B2 4/2005 Kushner et al.
6,918,153 B2 7/2005 Gruber
6,943,140 B2 9/2005 Ashton et al.
6,945,392 B2 9/2005 Furukawa et al.
6,984,278 B2 1/2006 Anderson et al.
7,017,781 B2 3/2006 Provenza
7,021,495 B2 4/2006 De Laforcade
7,090,097 B1 8/2006 Kazarian et al.
7,195,677 B2 3/2007 Morrisey-Hawkins
7,200,893 B2 4/2007 Gerber et al.
D544,096 S 6/2007 Walters et al.
7,232,042 B2 6/2007 Last
7,246,891 B2 7/2007 Qingguo et al.
7,320,956 B2 1/2008 Johnson et al.
7,392,566 B2 7/2008 Gordon et al.
7,469,703 B2 12/2008 France et al.
7,517,411 B2 4/2009 Hornsby et al.
2001/0022603 A1 9/2001 Eida
2002/0196312 A1 12/2002 Ishizawa et al.
2003/0071874 A1 4/2003 Ishizawa et al.
2003/0100870 A1 5/2003 Villefrance
2003/0164333 A1 9/2003 Nohren, Jr. et al.
2004/0107522 A1 6/2004 Paas
2004/0217127 A1 11/2004 Kimura et al.
2004/0256424 A1 12/2004 Johnson
2005/0035322 A1 2/2005 Davis et al.
2005/0040181 A1 2/2005 Kurosawa et al.
2005/0066996 A1 3/2005 France et al.
2005/0181996 A1 8/2005 Carney et al.
2005/0250662 A1 11/2005 Masotti et al.
2005/0282722 A1 12/2005 McReynolds et al.
2005/0286808 A1 12/2005 Zimmerman et al.
2006/0276363 A1 12/2006 Cagnina et al.
2006/0288516 A1 12/2006 Sawalski
2007/0025648 A1 2/2007 Micnerski et al.
2007/0205202 A1 9/2007 Hildebrand et al.
2007/0217718 A1 9/2007 Micnerski et al.

| | | | |
|---|---|---|---|
| 2007/0217719 | A1 | 9/2007 | Smith |
| 2007/0256270 | A1 | 11/2007 | Gordon et al. |
| 2008/0017558 | A1 | 1/2008 | Pollock et al. |

FOREIGN PATENT DOCUMENTS

| | | |
|---|---|---|
| EP | 0 709 207 | 5/1996 |
| EP | 0 965 780 | 12/1999 |
| EP | 1 270 235 | 1/2003 |
| JP | 60-003852 | 1/1985 |
| JP | 01-133749 | 5/1989 |
| JP | 04-214360 | 8/1992 |
| JP | 05-185603 | 7/1993 |
| JP | 05-229566 | 9/1993 |
| JP | 08-080616 | 3/1996 |
| JP | 10-258889 | 9/1998 |
| JP | 11-157093 | 6/1999 |
| JP | 2001-063090 | 3/2001 |
| JP | 2001-232812 | 8/2001 |
| JP | 2002-113881 | 4/2002 |
| JP | 2002-192739 | 7/2002 |
| JP | 2002-210960 | 7/2002 |
| JP | 2002-331684 | 11/2002 |
| WO | 9621599 | 7/1996 |
| WO | 2009071664 | 6/2009 |
| WO | 2009072156 | 6/2009 |

* cited by examiner

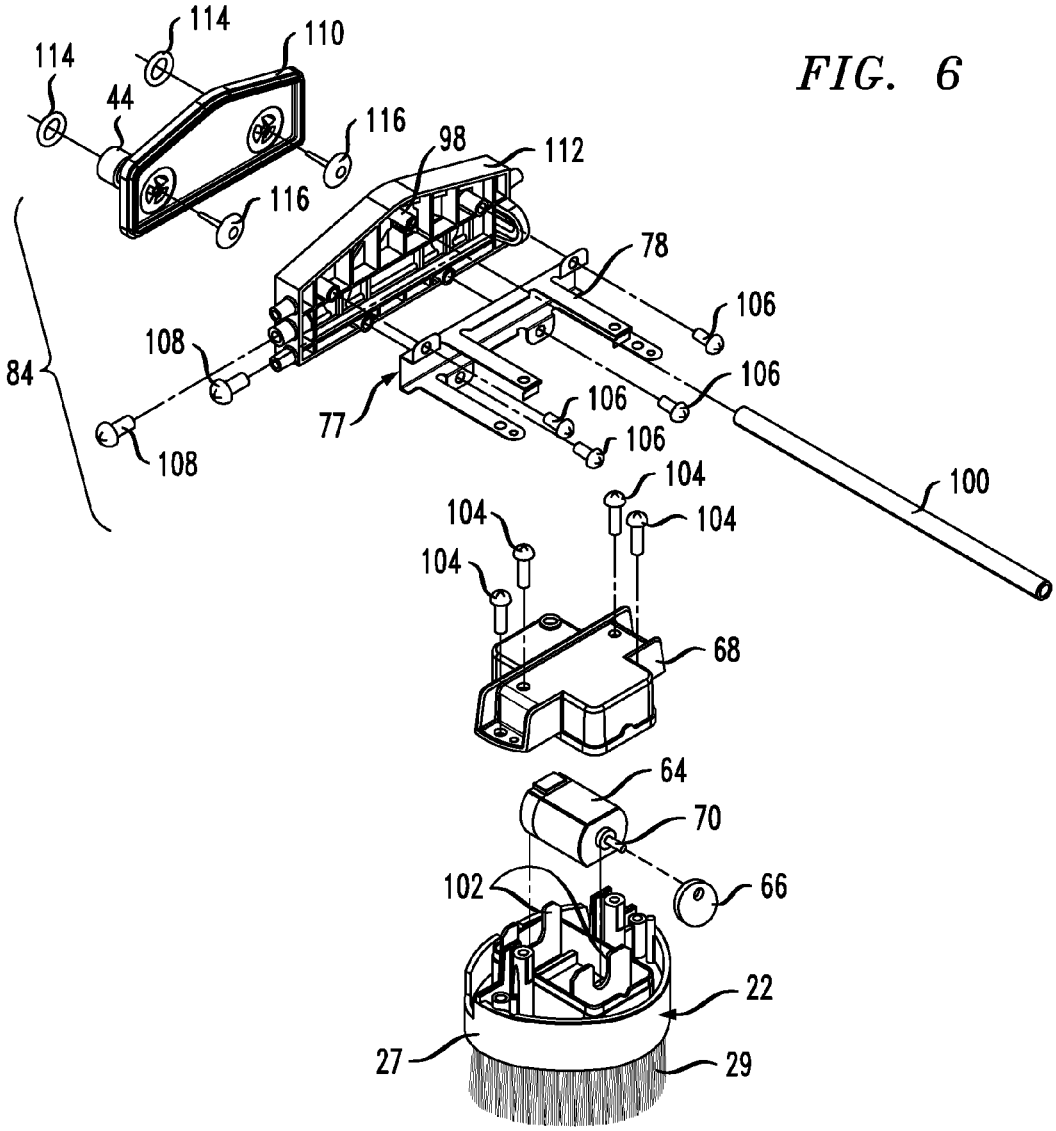
FIG. 6
FIG. 7
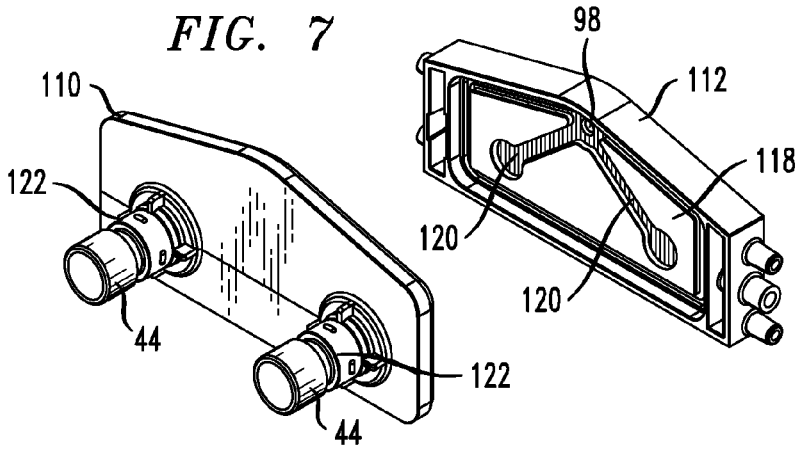

SURFACE TREATING DEVICE

FIELD OF THE INVENTION

The present invention relates to devices for treating a surface, and more particularly a surface treating device adapted for treating stains from articles composed of fabrics and textile-based materials such as carpets, rugs, and upholstery.

BACKGROUND OF THE INVENTION

Household furnishings and textile-based materials such as, for example, carpets, rugs, and upholstery, can last for many years, when properly treated. Routine vacuuming and regular cleaning helps to maintain the appearance and useful life of such materials. Occasional spills and stains do occur even in the most carefully maintained homes. Such stains are typically the result of a chemical reaction between the staining agent and the fibers and finishes of a fabric or textile-based material. Many stains can be treated with the proper method or technique.

Generally, the stain treatment process must be implemented immediately to prevent the stain from setting permanently in the material. The treatment process for the stains involves applying a stain-treating agent or a solvent for the stain, blotting the affected area with a cloth or sponge and/or tamping the stain with a spoon until the stain is treated. It is generally suggested that vigorous scrubbing and rubbing be avoided. Such action can irreparably damage or prematurely wear the material or spread the stain to a larger area or even push the stain deeper into the material. Unfortunately, consumers often fail to follow the suggestion against scrubbing or rubbing the stained material.

There are several motorized cleaning devices available marketed for removing stains entrenched in fabric and textile-based materials such as carpets, rugs and upholstery. Such devices typically include a drive train including a shaft. The shaft coupled to a bristle holder, may rotate, oscillate or reciprocate, and imparting a scrubbing or rubbing action. Accordingly, such prior art devices are not suitable for treating strains without causing some degree of damage or wear.

A number of compositions are formulated for treating stains. Consumers generally prefer stain treating compositions which contain or generate gas bubbles. One such composition is formulated from solutions of baking soda (i.e., sodium bicarbonate) and a peroxide compound (e.g., hydrogen peroxide). The peroxide component and the baking soda component chemically react to produce an effervescent action effective for treating stains. The composition does not produce potentially odorous and/or irritating chemicals that may leave a residue or rings after use. The major drawback to using peroxide/baking soda compositions is the inconvenience associated with handling multiple components. Because the two components are reactive on contact, they must be kept separate from one another during storage, and mixed in appropriate proportions immediately before application to the stain.

Accordingly, there is a need for a surface treating device that is designed to treat stains from fabric or textile-based materials such as carpets, rugs and upholstery, while avoiding the problems described above. There is a need for a surface treating device that operates in a manner consistent with accepted stain treating practices, and substantially minimizes damage or wear to the treated area of the material. There is a further need for a surface treating device capable of conveniently preparing and delivering a stain treating fluid formulated in proper amounts from one or more components to the surface of the material.

SUMMARY OF THE INVENTION

The present invention relates to a surface treating device for treating stains from fabric and textile-based materials including carpets, rugs and upholstery. The surface treating device of the present invention is specifically designed to provide enhanced handling with minimal operational difficulties, while avoiding or at least substantially minimizing damage and wear to the material. The surface treating device includes a member adapted for engaging a surface to be treated in a manner, which enhances treatment without damage or excessive wear. A driver is operatively associated with the member, and is adapted for imparting a linear reciprocating motion to the member, wherein the member engages the surface in a substantially perpendicular manner (i.e., a tamping motion). The member may be in the form of a brush having a plurality of bristles. The surface treating device of the present invention is portable, hand-holdable, and simple and convenient to use. Furthermore, the surface treating device of the present invention is compact in size for easy storage and handling, and is especially suitable for consumer use.

The surface treating device of the present invention may further include a single fluid source for storing a fluid or multiple separate discrete fluid sources for storing a plurality of fluids and for combining the fluids in a convenient manner. The single or combination of fluids is delivered to the treatable material in proximity of the cleaning member. Preferably, in one embodiment of the present invention, the multiple discrete fluid sources comprise a peroxide fluid such as an aqueous hydrogen peroxide solution in one, and a bicarbonate fluid such as an aqueous sodium bicarbonate solution in another. These fluid sources are maintained out of contact with one another (storage phase) until the combined fluid is used to clean a selected material. The discrete fluid sources may each be in the form of a pouch for facilitating easy replacement. The surface treating device of the present invention facilitates treatment of stains through both chemical and mechanical action. Accordingly, the surface treating device of the present invention offers a convenient self-contained comprehensive system for treating stains.

In one aspect of the present invention, there is provided a surface treating device, comprising:

a member adapted for engaging a surface to be treated;

a driver operatively associated with the member, the driver being adapted for imparting a linear reciprocating motion to the member, wherein the member engages the surface to be treated in a manner substantially perpendicular to the surface to be treated; and a dispenser for delivering a fluid, drawn directly from a discrete fluid source, to the surface being treated.

In a further aspect of the present invention, there is provided a surface treating device, comprising:

a member having a plurality of bristles adapted for engaging a surface to be treated; and a driver operatively associated with the member, the driver being adapted for imparting a linear reciprocating motion to the member, wherein the bristles engage the surface to be treated in a manner substantially perpendicular to the surface to be treated.

In a still further aspect of the invention, there is provided a fitment for a pouch for storing one of the fluids, comprising:

a valve portion for permitting passage of a fluid therethrough;

a fitment body housing the valve portion, the fitment body being adapted for attachment to a pouch; and a throughhole extending laterally through the fitment body in communication with the interior of the pouch for permitting any gas present in the pouch to pass out of the pouch while at least substantially preventing passage of a liquid therethrough.

In another aspect of the present invention, there is provided a pouch comprising:

a flexible wall defining a fluid cavity for accommodating a fluid; and a fitment comprising:

a) a valve portion for permitting passage of a fluid therethrough from the fluid cavity;

b) a fitment body housing the valve portion, the fitment body being adapted for attachment through the flexible wall of the pouch; and c) a throughhole extending laterally through the fitment body in communication with the fluid cavity for permitting any gas present in the pouch to pass out of the pouch while at least substantially preventing passage of a liquid therethrough.

In another aspect of the present invention, there is provided a plug comprising:

a tubular body having first and second ends, the first end configured for engaging a throughhole extending laterally through a fitment;

a laterally inclined opening located at the second end of the tubular body; and a gas permeable membrane sealing the laterally inclined opening.

BRIEF DESCRIPTION OF THE DRAWINGS

The following drawings are illustrative of embodiments of the present invention and are not intended to limit the invention as encompassed by the claims forming part of the application.

FIG. 6 is an exploded assembly view of a surface treating member and driver assembly and a fluid manifold assembly of the surface treating device in accordance with the present invention;

FIG. 7 is an exploded assembly view of the fluid manifold assembly of the surface treating device in accordance with the present invention;

DETAILED DESCRIPTION OF THE INVENTION

Figure 1:
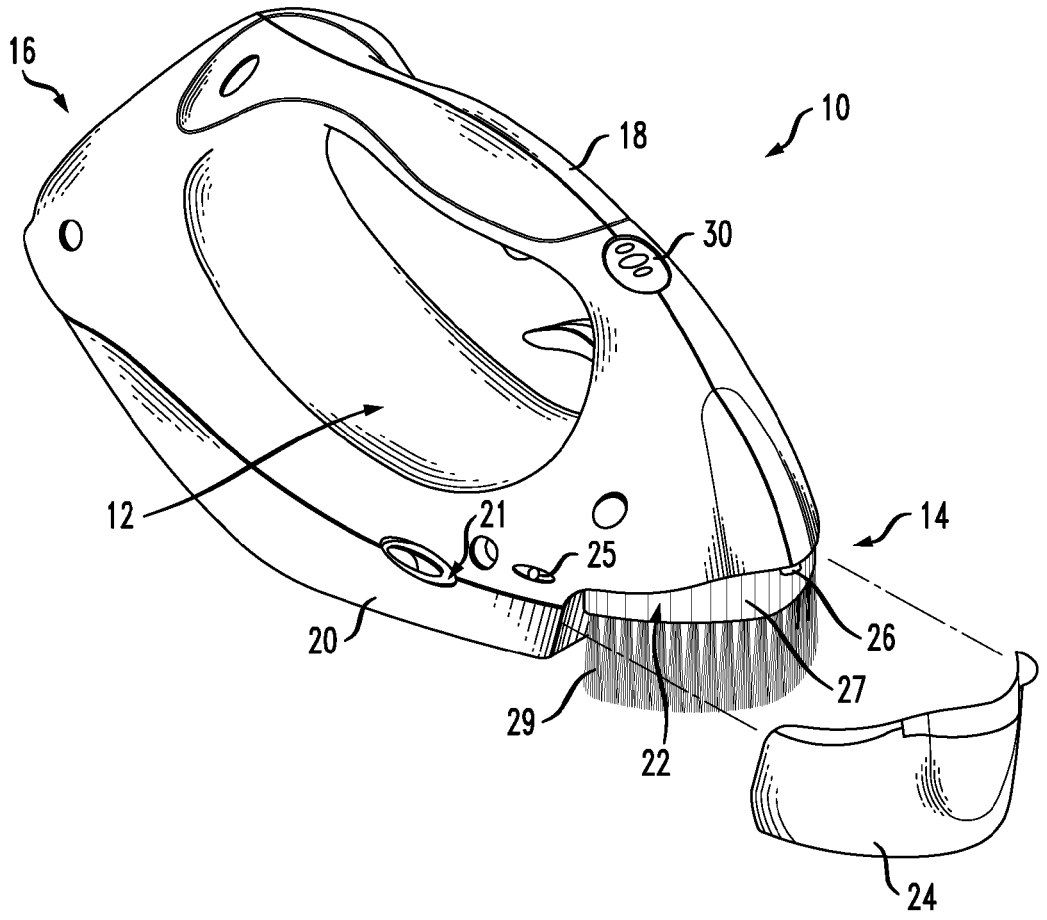
FIG. 1 is a front perspective view of a surface treating device with a brush cover for one embodiment of the present invention.

The present invention is directed to a surface treating device for treating stains from fabric and textile-based materials including carpets, rugs and upholstery. The surface treating device of the present invention is specifically designed to provide enhanced handling with minimal operational difficulties, while avoiding or at least substantially minimizing damage and wear to the surface to be treated. The surface treating device includes a member adapted for engaging a surface to be treated in a manner, which enhances treatment without damage or excessive wear. A driver is operatively associated with the member, and is adapted for imparting a linear reciprocating motion to the member. As a result, the member engages in a path perpendicular to the surface to thereby provide a "tamping" action. As used herein the word "tamping" shall mean rapidly repeating movement of the device to contact with the surface in a direction or orientation perpendicular to the surface.

The member may be in the form of a brush having a plurality of bristles. The surface treating device of the present invention is portable, hand-holdable, and simple and convenient to use. Furthermore, the surface treating device of the present invention is compact in size for easy storage and handling, and is especially suitable for consumer use.

The surface treating device of the present invention may further include a dispenser for delivering a fluid for assisting in the cleaning of the surface. The fluid may be drawn from a single fluid source or multiple fluid sources. Preferably, as more fully described below, the fluid is comprised of a plurality of fluids, preferably mixed together (i.e., a combined fluid) drawn directly from a plurality of discrete fluid sources and delivered to the surface being treated. Preferably, the combined fluid is the combination of a peroxide fluid such as an aqueous hydrogen peroxide solution and bicarbonate fluid such as an aqueous sodium bicarbonate solution.

Multiple discrete fluid sources may employed when it is desirable to separate the fluids from one another until the surface treatment process commences because the fluids rapidly react with one another as would occur when the fluids are, for example, a bicarbonate fluid and a peroxide fluid. The discrete fluid sources which house the fluids may be in the form of replaceable pouches. The treatment of stains and other cleaning functions are facilitated by the chemical action of the fluid and the mechanical action of the bristles and their linear reciprocating motion. Accordingly, the surface treating device of the present invention offers a convenient self-contained comprehensive system for treating stains and performing other cleaning functions. It will also be understood that the present invention may be configured to dispense a fluid from a single unitary fluid source such as a solution mixture of peroxide and bicarbonate, for example.

The term "fluid" refers generally to a substance, ingredient, composition or formulation, which may be inert, active or reactive (e.g., as forming part of a multi-component solution), and which is to be stored separately and optionally subsequently mixed with one or more other substances, ingredients, compositions or formulations, which may be inert, active or reactive, immediately prior to delivery to a surface to be treated for initiating treatment of stains or performing other related functions such as sanitization, odor removal, dander removal, and the like.

The term "discrete fluid source" refers to any storage means including, but not limited to, pouches, bags, compartments, hard and soft containers, and the like for storing a fluid, and, in embodiments having multiple discrete fluid sources, out of contact with other fluids. Preferably, the present invention is adapted to accommodate two fluids each contained within respective discrete fluid sources, for example, where one fluid source contains a peroxide such as an aqueous hydrogen peroxide solution, and the other fluid source contains a bicarbonate such as an aqueous sodium bicarbonate solution.

Figure 2:
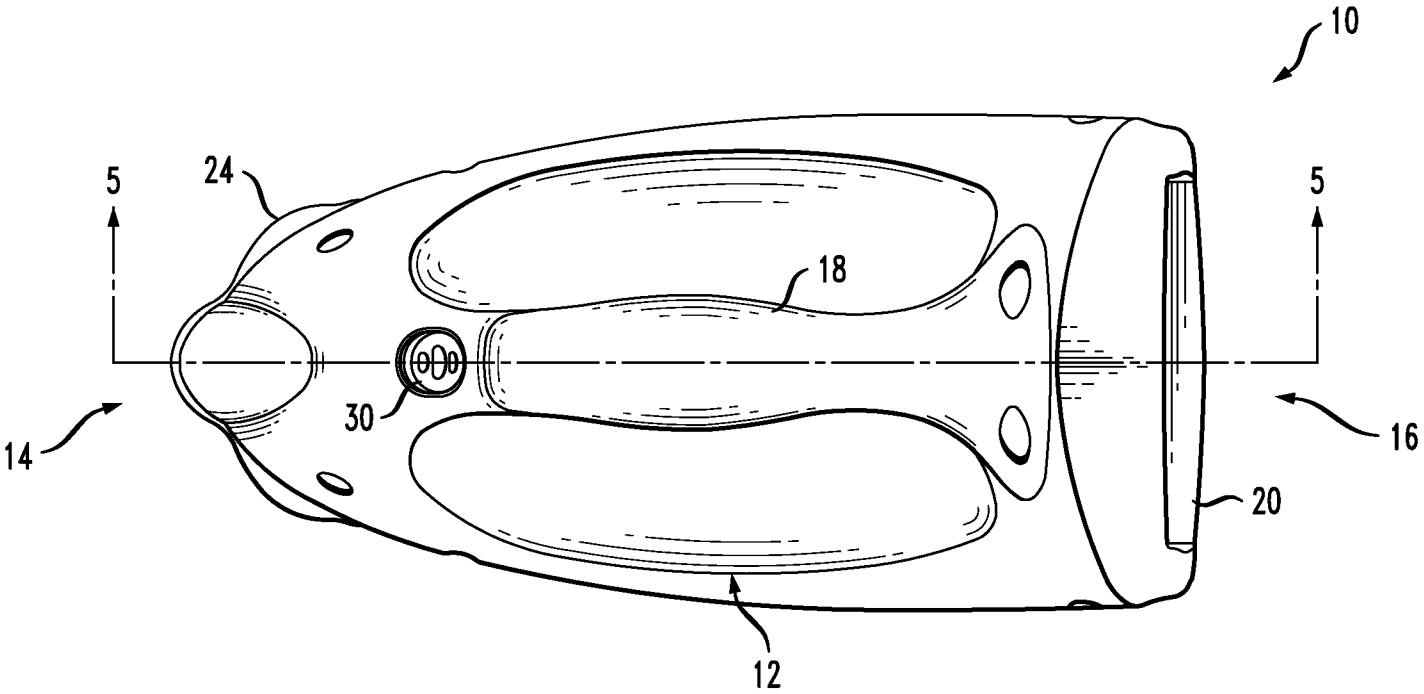
FIG. 2 is a top plan view of the surface treating device in accordance with the present invention.
Figure 3:
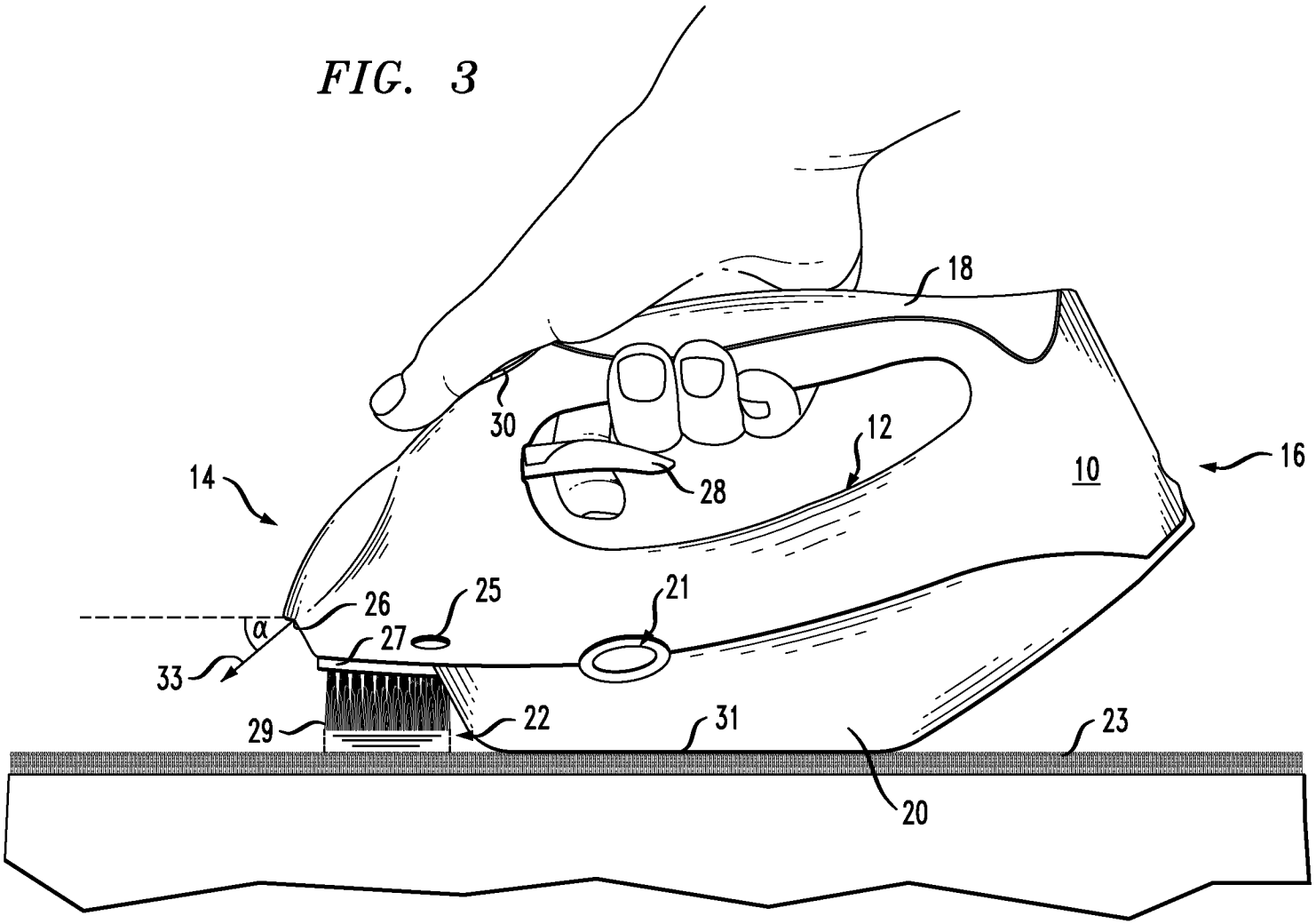
FIG. 3 is a left side elevational view of the surface treating device treating the surface in accordance with the present invention.

Referring to FIGS. 1 through 3, a surface treating device, identified generally by reference numeral 10, is shown for one embodiment of the present invention. The surface treating device 10 includes a housing 12 with a forward end 14, a rear end 16 and a handle 18 extending along an upper portion thereof, a base member cover 20 hingedly attached to the rear end 16 of the housing 12 and secured to the housing 12 via a latch 21. The housing 12 and the base member cover 20 are preferably constructed from an extruded or molded rigid plastic material. The device 10 further includes a surface treating member 22 extending downwardly from the front end 14 of the housing 12. The surface treating member 22 is specifically adapted for engaging a surface to be treated through agitation by rapidly repeating upward and downward movements (i.e., tamping movement) so that the operative motion of the surface treating member 22 is substantially perpendicular to the surface to be treated. The tamping movement alone or together with the use of the fluid thereby promotes cleaning and stain treating action and other functions as will be further described hereinafter.

Optionally, the surface treating device 10 may include a brush cover 24 adapted to attach to the front end 14 of the housing 12 to enclose and guard the surface treating member 22 during non-use or storage. The brush cover 24 is secured to the housing front end 14 via engagement between projections (not shown) located on the interior side of the brush cover 24 and corresponding retaining notches 25 located on opposing sides of the housing 12. The surface treating device 10 may be stored in a prone position with the brush cover 24 attached or in a standing position.

The surface treating device 10 further includes a fluid dispensing outlet 26 located proximate to the member 22 at the front end 14 of the housing 12 through which a cleaning fluid such as a stain treating fluid may be dispensed. The stain treating fluid is delivered from the outlet 26 through actuation of a trigger 28 located on the inside portion of the handle 18 (shown best in FIG. 3) as will be further described hereinafter. To dispense an amount of the stain treating fluid, the trigger 28 is moved towards the handle 18 from a normally lower position to an upper position. The outlet 26 is configured to produce a line of spray 33 oriented at an angle of spray, $\alpha$, relative to horizontal with the device 10 resting on the base member cover 20. The angle of spray $\alpha$ is preferably in the range of from about 40° to 80°, more preferably 30° to 70° and most preferably at about 60° relative to horizontal.

The stain treating fluid may be selected from any composition or formulation comprising one or more ingredients which may be known in the art for treating stains from articles or for performing other functions (e.g., sanitization, deodorization) including, but not limited to, water, solvents, detergents, acids, alkalis, bleaches, enzymes, and the like. The stain treating fluid may be delivered from a single discrete fluid source. In a preferred embodiment of the invention, the stain treating fluid is a combined fluid composed of mixture of a peroxide fluid such as an aqueous hydrogen peroxide solution, and a bicarbonate fluid such as an aqueous sodium bicarbonate solution, where the fluids are combined immediately prior to being delivered to the surface to be treated. Alternatively, the peroxide fluid and the bicarbonate fluid may be stored together as a solution mixture within a single fluid source.

As shown in FIG. 3, the surface treating member 22 is operatively mounted on the front end 14 of the housing 12. The surface treating member 22 is adapted for reciprocating movement in the vertical direction (i.e., upwardly and downwardly in a path substantially perpendicular to the surface to be treated in a tamping motion) for engagement with the surface 23 (e.g., carpet, rug). In this manner, the surface treating member 22 aggressively agitates the surface to be treated to maximize cleaning and stain treating action, while minimizing any damage and wear to the agitated surface 23. The agitating action of the surface treating member 22 is initiated via a power button 30 located opposite the trigger 28 on the exterior portion of the handle 18 as will be further described hereinafter. The power button 30 and the trigger 28 are suitably positioned for easy reach by the consumer's fingers while holding the device 10.

The surface treating member 22 includes a bristle holder 27 movably attached to the surface treating device 10, and a plurality of bristles 29 extending downwardly from the bottom of the bristle holder 27. The surface treating member 22 is normally positioned with the distal ends of the bristles 29 a distance below the base member cover 20. This ensures sufficient contact and pressure is applied to the surface 23 to be treated during operation. The bristles 29 directly engage the surface 23 during the tamping motion. It will be understood that the surface treating member 22 may be configured to substitute the bristles 29 with other forms of surface engaging elements including, but not limited to, woven materials such as fabrics, non-woven materials such as sponges and pads, relatively hard materials such as metals, wood or plastic, and the like, as known to one of ordinary skill in the art.

The base member cover 20 includes a surface contact portion 31 extending along the bottom area thereof. As discussed previously, the distal ends of the bristles 29 extends, in the absence of pressure thereto, a distance below the base member cover 20, or the surface contact portion 31. Preferably, the distance is at least 1 mm, more preferably from about 1 mm to 10 mm, and most preferably, at about 3 mm below the surface contact portion 31. The device 10 is placed with surface contact portion 31 proximately to the surface to be treated. The surface contact portion 31 is configured to appropriately orient and position the surface treating member 22 at the proper angle and distance relative to the surface 23. This ensures proper operation of the surface treating device 10, and minimizes damage or premature wear on the surface 23.

Once the surface treating member 22 is properly positioned, the agitating action of the surface treating member 22 is initiated via the power button 30. With the surface contact portion 31 in contact with the surface 23, the bristle holder 27 and the bristles 29 reciprocate along a vertical axis normal to the affected area. The bristles 29 periodically contact the surface 23 in a rapid, reciprocating manner to produce the tamping movement with sufficient agitation to effectively treat stains or perform another desired function. In the present embodiment of the invention, the surface treating member 22 is configured to reciprocate at a rate of at least 1,000 Hz, preferably from about 1,000 Hz to 15,000 Hz, and more preferably from about 5,500 Hz to 7,000 Hz.

Figure 4:
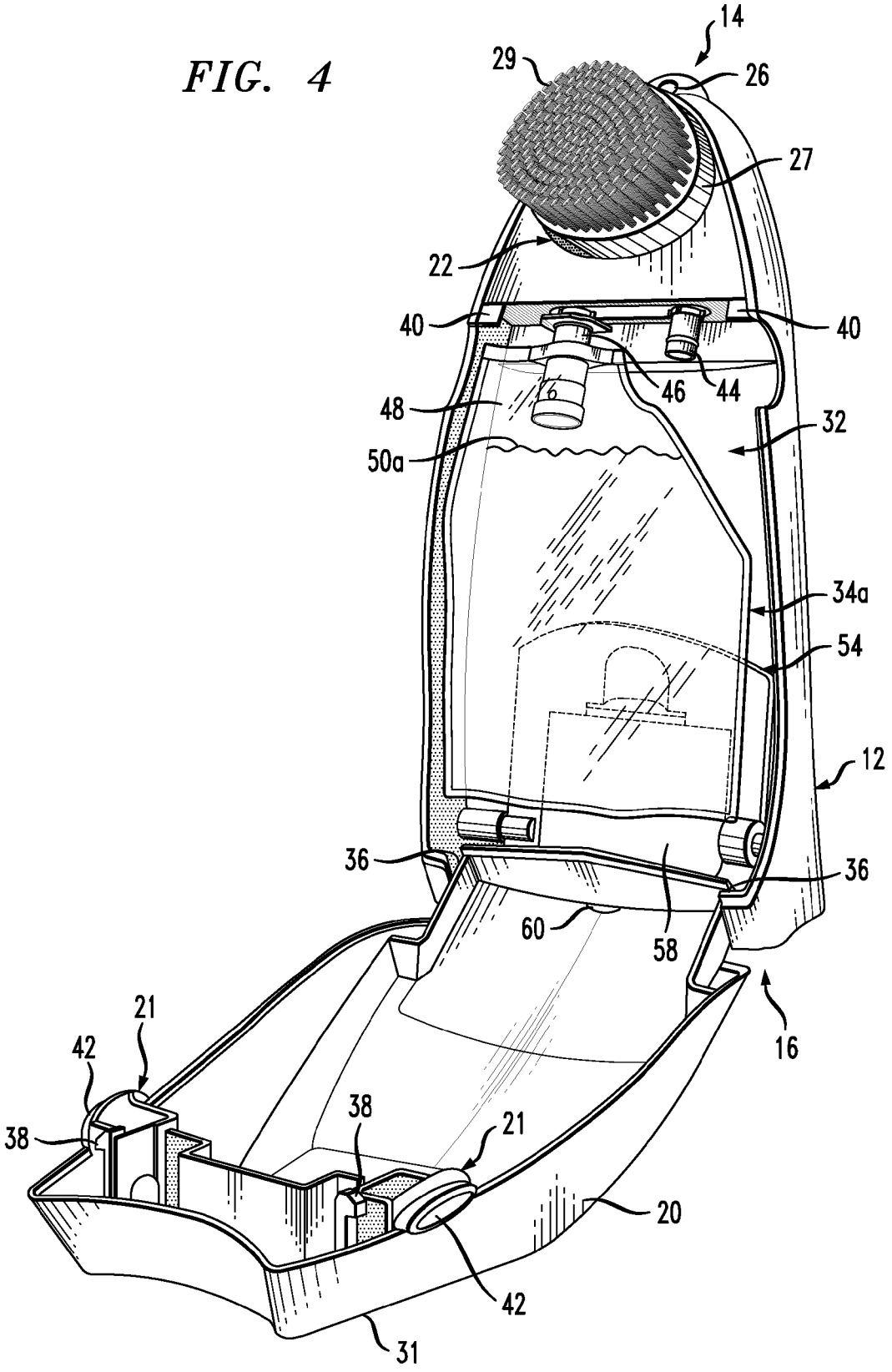
FIG. 4 is a perspective view of the bottom portion of the surface treating device open showing a fluid pouch coupled to an inlet port within the interior compartment in accordance with the present invention.

Referring to FIG. 4, the housing 12 and the base member cover 20 define an interior compartment 32 for receiving and holding one or more discrete fluid sources preferably in the form of pouches 34. Although the fluid sources in the present embodiment is preferably a pouch 34, it will be understood that the fluid sources can encompass other forms including, for example, hard or soft containers. The base member cover 20 is movable from the closed position shown in FIGS. 1-3 to the open position shown in FIG. 4 via a hinge connection 36 to the housing 12.

The latch 21 includes a pair of outwardly biased protrusions 38 configured for releasable engagement with corresponding keepers 40 of the housing 12. The latch 21 operates to securely lock the base member cover 20 in the closed position. The protrusions 38 of the latch 21 may be selectively disengaged from the keepers 40 by depressing release buttons 42 located on the exterior portion of the device 10. Once the latch 21 is disengaged, the base member cover 20 can be moved to an open position thereby gaining access to the interior compartment 32.

The surface treating device 10 includes one or more inlet ports 44 each configured for fluidly coupling with a pouch 34 via a fitment 46. The fitment 46 includes a fitment valve (not shown), which opens to permit fluid flow only when the inlet port 44 is fully seated therein. Thus, the fitment valve (not shown) is configured only for either fully open or fully closed states. Each of the pouches 34 comprises sidewalls 48 for storing a fluid 50. As discussed previously, the fluid 50 may comprise a substance, ingredient, composition or formulation, which may be inert, active or reactive, alone or as part of a combined fluid for performing a stain treating or related function.

The sidewalls 48 of the pouch 34 are fluidly sealed with the fitment 46. The fitments 46 are adapted to receive and retain (e.g., by snapping) a corresponding inlet port 44 therein to establish fluid coupling therebetween. When the trigger 28 (see FIG. 3) is actuated, the fluid 50 is drawn from the pouch 34 through the pouch fitment 46 via the corresponding inlet port 44. The fitments 46 are configured for easy disengagement from the inlet ports 44 to permit replacement of the pouches 34 as needed. Accordingly, the surface treating device 10 facilitates extended use by accommodating replacement pouches to provide a new supply of the same or different fluids In a preferred embodiment of the invention, the surface treating device 10 is adapted to accommodate two pouches 34. One pouch is shown in FIG. 4 while the other pouch will at least partly rest over the pouch as shown. One pouch 34 may be used to store a first fluid 50*a*, preferably a peroxide fluid such as an aqueous hydrogen peroxide solution. The concentration of the peroxide in the peroxide solution may range from about 0.001% to 50%, and preferably from about 0.1% to 20% by weight. The other pouch 34 may be used to store a second fluid 50*b* (not shown), preferably a bicarbonate fluid such as an aqueous sodium bicarbonate solution. The concentration of the bicarbonate in the bicarbonate solution may range from 0.001% to 50%, and preferably from about 0.1% to 20% by weight. It will be understood that the peroxide solution and the bicarbonate solution may alternatively be packaged as a single premixed solution for use in the present invention.

The surface treating device 10 includes a battery housing assembly 54 with a battery compartment 56 (see FIG. 5) and a battery cover 58 for holding one or more batteries 76 (see FIG. 5) which supplies electrical power required for reciprocating the surface treating member 22 as will be further described hereinafter. The battery housing assembly 54 is accessible via the interior compartment 32.

The housing 12 is constructed to provide a fluid resistant seal between the interior compartment 32 and the other internal components in the device 10. In the event of a fluid leak from one of the pouches 34, a fluid drain opening 60 is provided in the base member cover 20 to effectively channel the leaking fluid from the device 10 and away from the internal components.

Figure 5:
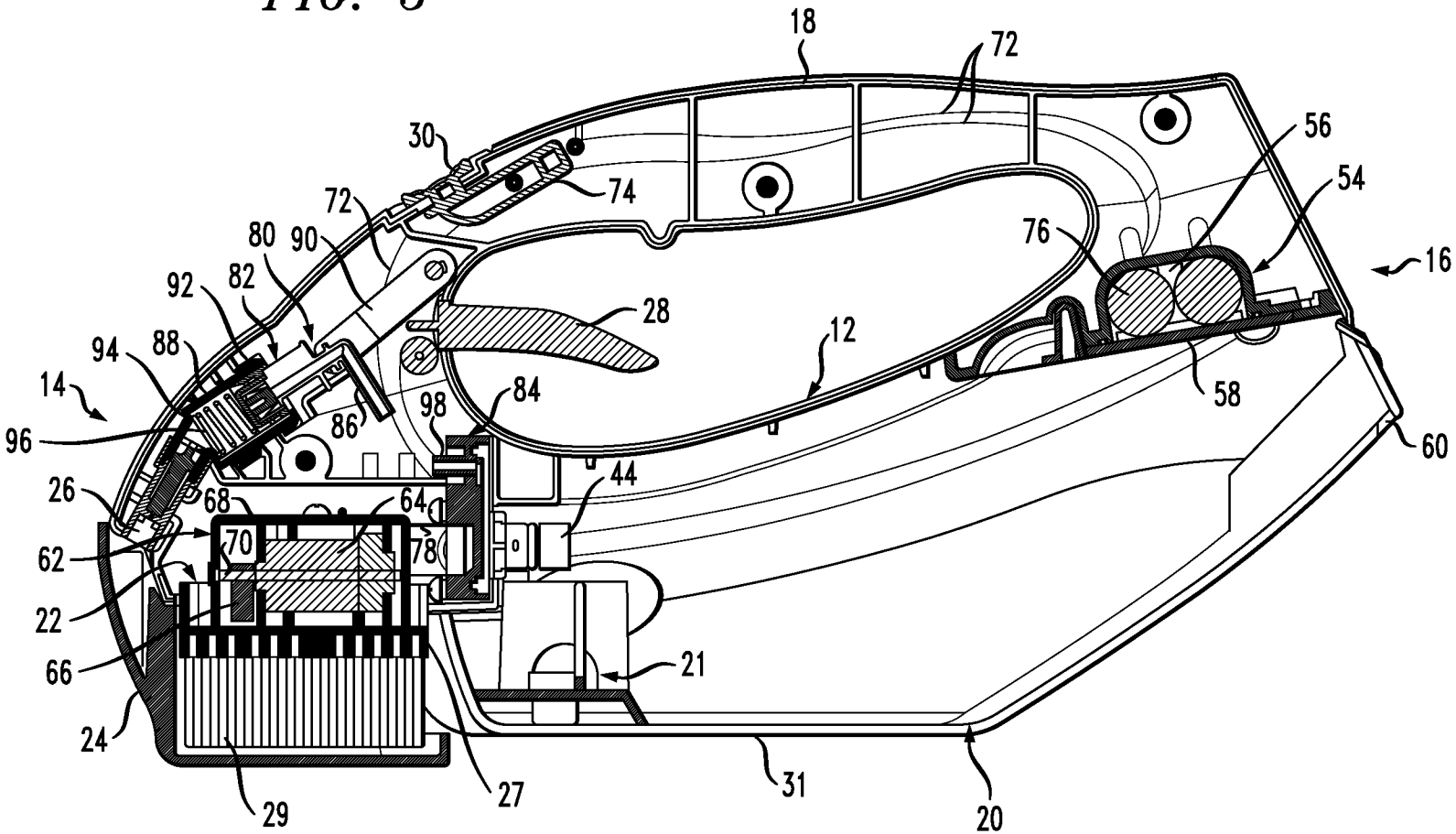
FIG. 5 is a cross sectional view of the surface treating device along lines 5-5 of FIG. 2 in accordance with the present invention.

Referring to FIG. 5, a detailed illustration of the interior of the surface treating device 10 is shown. The surface treating member 22 is operatively associated with an agitation assembly or driver 62. The driver 62 is affixed to the top portion of the bristle holder 27, and is adapted for imparting a linear reciprocating motion to the surface treating member 22. The driver 62 includes an oscillating motor 64 having an off-centered weight 66, and a motor housing 68 enclosing and sealing the motor 64. The motor 64 of the driver 62 includes a drive shaft 70 attached to the off-centered weight 66, and is powered via electrical leads 72 from the batteries 76 of the battery housing assembly 54. A switch 74, electrically connected to the electrical leads 72 and actuated by the power button 30, regulates the supply of electrical power to the motor 64.

The driver 62 and the surface treating member 22 are movably attached to the housing 12 via a spring mechanism preferably in the form of cantilever spring 77 (see FIG. 6) having a plurality of flexible beams or cantilevers 78. The cantilever spring 77 is selected with a suitable spring rate for facilitating the tamping motion of the bristle holder 27. Preferably, the spring rate of the cantilever spring 77 is at least 100 N/m, more preferably from about 100 N/m to 3,000 N/m, and most preferably, from about 60 N/m to 1,600 N/m.

The motor housing 68 provides an upper limit to the vertical movement of the driver 62 and surface treating member 22 relative to the surface to be treated. The bristles 29 thereby extend sufficiently into the surface 23 to perform the desired cleaning function without damaging or causing excessive wear of the surface 23. During operation, the motor 64 causes the drive shaft 70 and the off-centered weight 66 to rotate within the motor housing 68. The momentum generated by the rotating off-centered weight 66 effectively causes the surface treating member 22 to reciprocate in an up and down motion, thereby producing the tamping action on the surface to be treated. The reciprocation rate is at least 1,000 Hz, preferably from about 1,000 Hz to 15,000 Hz, and more preferably from about 5,500 Hz to 7,000 Hz.

The surface treating device 10 includes a fluid dispensing assembly 80 for storing and delivering a desired fluid such as a combined fluid to the surface to be treated. In the present embodiment of the invention, the fluid dispensing assembly 80 is adapted to draw fluids from two discrete fluid sources each in the form of pouches 34 (see FIG. 4) to produce a combined fluid, which may be used to treat stains or perform other functions as previously described (e.g., sanitization, deodorization).

The fluid dispensing assembly 80 includes a pump assembly 82, and a fluid manifold assembly 84 adapted to mix the respective fluids 50*a* and 50*b*, and convey to the pump assembly 82, fluids 50*a* and 50*b* from the respective pouches 34*a* and 34*b* via the inlet ports 44 (only fluid 50*a* and pouch 34*a* are shown). The pump assembly 80 includes an inlet 86, a pump 88, the fluid dispensing outlet 26, the trigger 28 and an actuating linkage or yoke 90 located between the trigger 28 and the pump 88. The pump includes a movable plunger 92, a pump cavity or chamber 94, and a spring 96. The movable plunger 92 is actuated by the trigger 28 via the actuating linkage or yoke 90, and is adapted to permit one-way flow of fluid from the pump inlet 86 into the pump chamber 94.

As the trigger 28 is pulled up against the handle 18, the plunger 92 moves downwardly within the pump chamber 94 and forces fluid through the fluid dispensing outlet 26. The pump spring 96 biases the plunger 92 upwardly for the return stroke, which generates a negative pressure at the pump inlet 86. The pump inlet 86 is fluidly connected to a manifold outlet 98 of the fluid manifold assembly 84 via a hose or tube 100 (see FIG. 6). The negative pressure generated at the pump inlet 86 draws the fluids 50*a* and 50*b* from the pouches 34*a* and 34*b*, respectively, into the fluid manifold assembly 84 via the corresponding inlet ports 44. The drawn fluids 50*a* and 50*b* are mixed together in the fluid manifold assembly 84 to form a combined fluid and then conveyed to the pump assembly 82 for dispensing. The drawn fluids 50*a* and 50*b* are preferably mixed in a volume ratio of from about 30:70 to 70:30, and more preferably about 50:50.

Referring to FIGS. 6 and 7, the oscillating motor 64 is affixed to mounting brackets 102 disposed on the top portion of the surface treating member 22. The motor housing 68 encloses the motor 64 therein, and is fastened to the surface treating member 22 and the distal ends of the cantilevers 78 via screw fasteners 104. The proximal end of the cantilever spring 77 is fixedly mounted to the fluid manifold assembly 84 via screw fasteners 106. The fluid manifold assembly 84 is fixedly mounted to the interior of the housing 12 via screw fasteners 108. The hose 100 is fluidly connected between the manifold outlet 98 and the pump inlet 86.

The fluid manifold assembly 84 includes an inlet plate 110 having the inlet ports 44, and an outlet plate 112 having the manifold outlet 98. The inlet ports 44 each include an O-ring 114 seated thereon to provide a sealing engagement with the fitment 46 of the pouches 34, and a check valve, preferably in the form of an umbrella valve 116, disposed within the interior side thereof to provide a one-way only flow from the pouch 34 into the manifold assembly 84, when the pump assembly 82 is actuated. The check valves 116 prevent cross contamination of the respective fluids 50*a* and 50*b* upstream (i.e., fluid 50*a* contaminating fluid 50*b* contained in the pouch 34*b*). Such contamination can adversely affect the efficacy of the respective fluids over time during non-use. It is further noted that the manifold configuration and the position of the check valves 116 substantially reduces the residual volume of the mixed fluids within the pump assembly 82 and the corresponding fluid delivery path to the fluid dispensing outlet 26. This results in reduced waste and enhanced delivery of the newly combined fluid to the surface to be treated.

As shown in FIG. 7, the outlet plate 112 includes a recessed area 118, and a pair of channels 120 disposed within the recessed area 118 in communication with the manifold outlet 98. The inlet plate 110 is configured to fit within the recessed area of the outlet plate 112 to enclose the channels 120. The inlet ports 44 further include grooves 122 to provide secure seating and retainment of the O-rings 114 thereon. The enclosed channels 120 each provide fluid communication between the corresponding inlet ports 44 and the manifold outlet 98.

Figure 8:
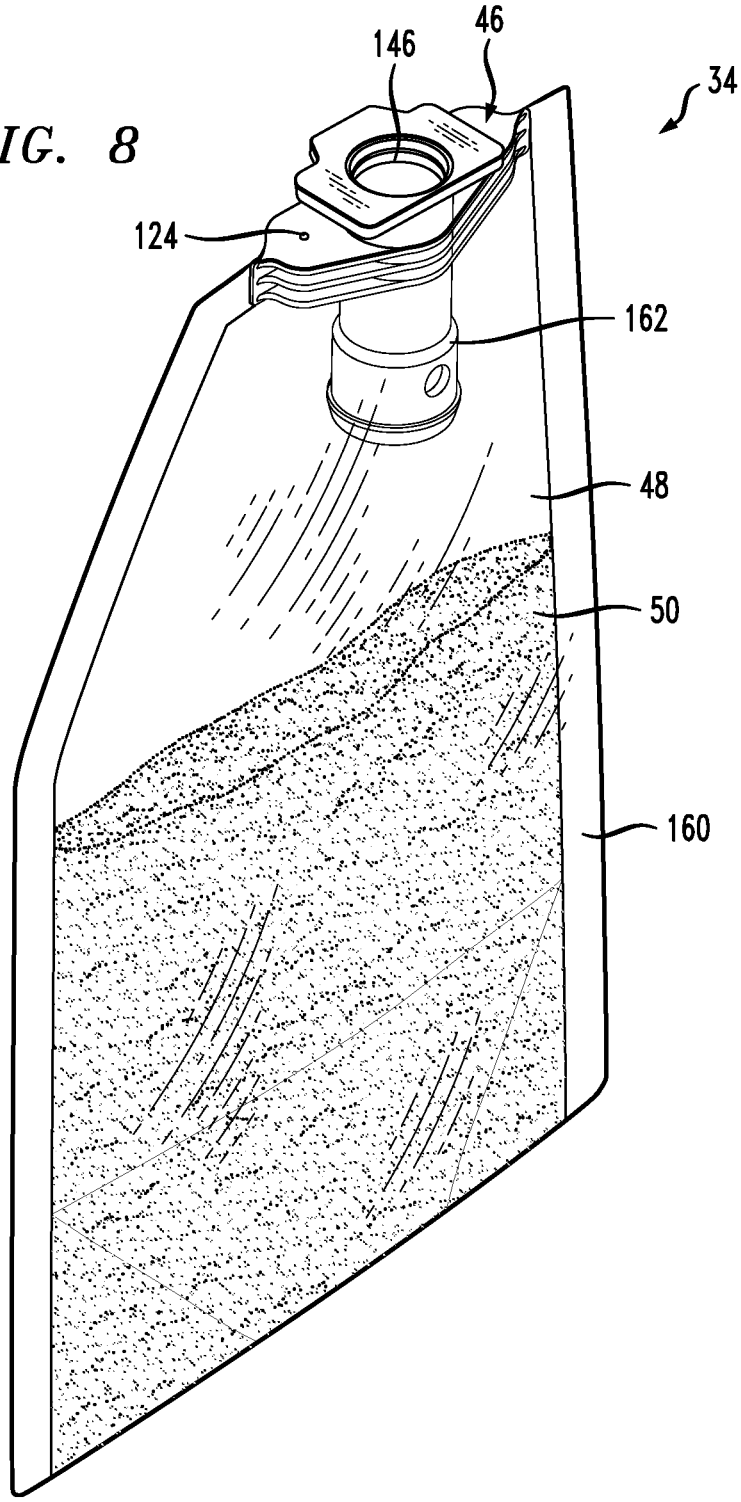
FIG. 8 is a perspective view of a fluid pouch having an optional gas vent in accordance with the present invention.

Referring to FIG. 8, the pouch 34 includes the sidewalls 48 which are sealed to one another along an edge portion 160. The means for sealing the sidewalls 48 may be achieved through heat sealing methods. The fitment 46 is sealed between the sidewalls 48 with an inlet port receiving opening 146 located on the exterior side, and fluid drawing portion 162 located on the interior side of the pouch 34. The inlet port receiving opening 146 is configured to receive and retain therein the corresponding inlet port 44 of the surface treating device 10 to provide a fluid coupling therebetween. The fitment 46 is open to allow the fluid 50 through only when the inlet port 44 is fully inserted into the inlet port receiving opening 146. Otherwise, the fitment 46 remains closed and the fluid 50 is prevented from passing therethrough.

During storage, the fluid 50 contained within the pouch 34 (e.g., bicarbonate solution, peroxide solution) may generate gas, which over time can cause the pouch sidewalls 48 to expand resulting in an undesirable bloated appearance and/or release of fluid. To address the possible buildup of gas, the pouch 34 includes a optional gas vent 124 disposed in the fitment 46 for permitting a gas to pass from the pouch 34 while at least substantially preventing passage of the fluid therethrough. It will be understood that the gas vent is optional particularly where the fluid contained in the pouch 34 lacks the tendency to emit or generate gas.

The gas vent 124 allows a sufficient amount of gas to vent from the pouch 34 so that the pouch 34 retains its normal profile (i.e., prevents the pouch 34 from taking on a bloated appearance). The gas vent 124 provides communication between the interior or the pouch 34 and ambient to permit excess gas only to be released. In the present embodiment of the invention, the gas vent 124 further includes a gas permeable membrane 126 (see FIG. 9) sealed thereacross which facilitates the release of excess gas only.

Figure 9:
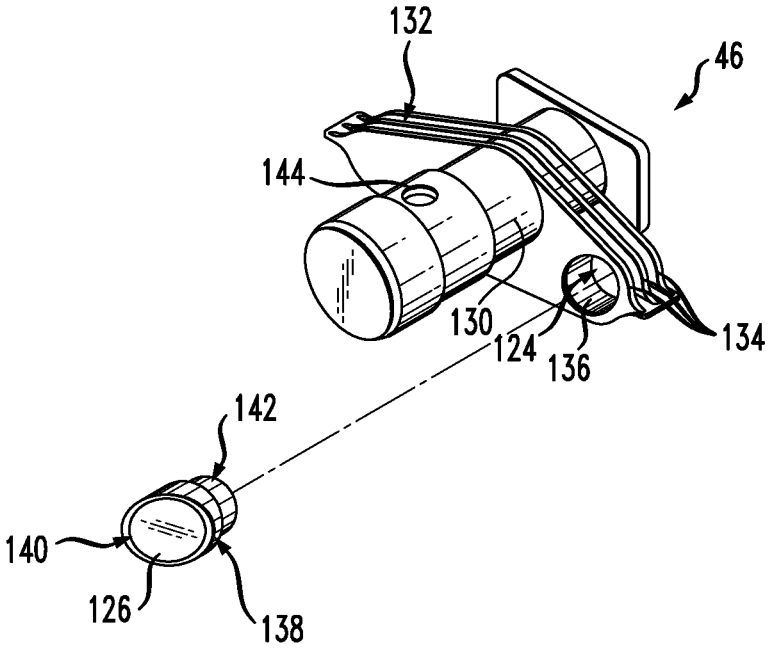
FIG. 9 is an enlarged, perspective view of a fitment from the interior side with the optional gas vent adapted for receiving a gas permeable plug in accordance with the present invention.

Referring to FIG. 9, the fitment 46 includes a valve spring (not shown), a spring cap 128, a fitment valve (not shown), and a fitment body 130 including the inlet port receiving opening 146 and the fluid drawing portion 152 (see FIG. 8) housing the fitment valve. The fitment body 130 includes a fluid inlet 144, a canoe-shaped base 132 having a plurality of spaced apart fins 134 oriented on opposed sides of the fitment body 130. The canoe-shaped base 132 is positioned coextensively between the edge portion 160 of the sidewalls 48 of the pouch 34 (see FIG. 8), where it adheres to the inside surface of the sidewalls 48 to provide a fluid seal therebetween. The base 132 and the fins 134 are suitably shaped to provide good surface contact with the sidewalls 48. In a preferred embodiment of the invention, the fins 134 of the base 132 are coated with or composed of a meltable material that when heated, adheres with the inside surface of the sidewalls 48 to provide a continuous seal therebetween.

The fitment base 132 includes the gas vent 124 extending from the exterior side and opens up into a larger diameter throughbore 136 extending to the interior side thereof. The throughbore 136 is configured to receive a tubular gas permeable plug 138. The gas permeable plug 138 includes a laterally inclined opening 140 at one end, an opposing circular open end 142, and the gas permeable membrane 126 sealing the laterally inclined opening 140. The circular open end 142 of the plug 138 is inserted into the throughbore 136 and retained (e.g., by snapping) therein. An adhesive may be applied to securely retain the plug 138 within the throughbore 136.

The gas permeable membrane 126 is preferably a gas permeable film material configured for allowing gas and vapors to pass, while blocking passage of liquid therethrough. Such film materials are commercially available such as GORE-TEX® membrane from W.L. Gore & Associates, Inc. of Newark, Del.

Figure 10:
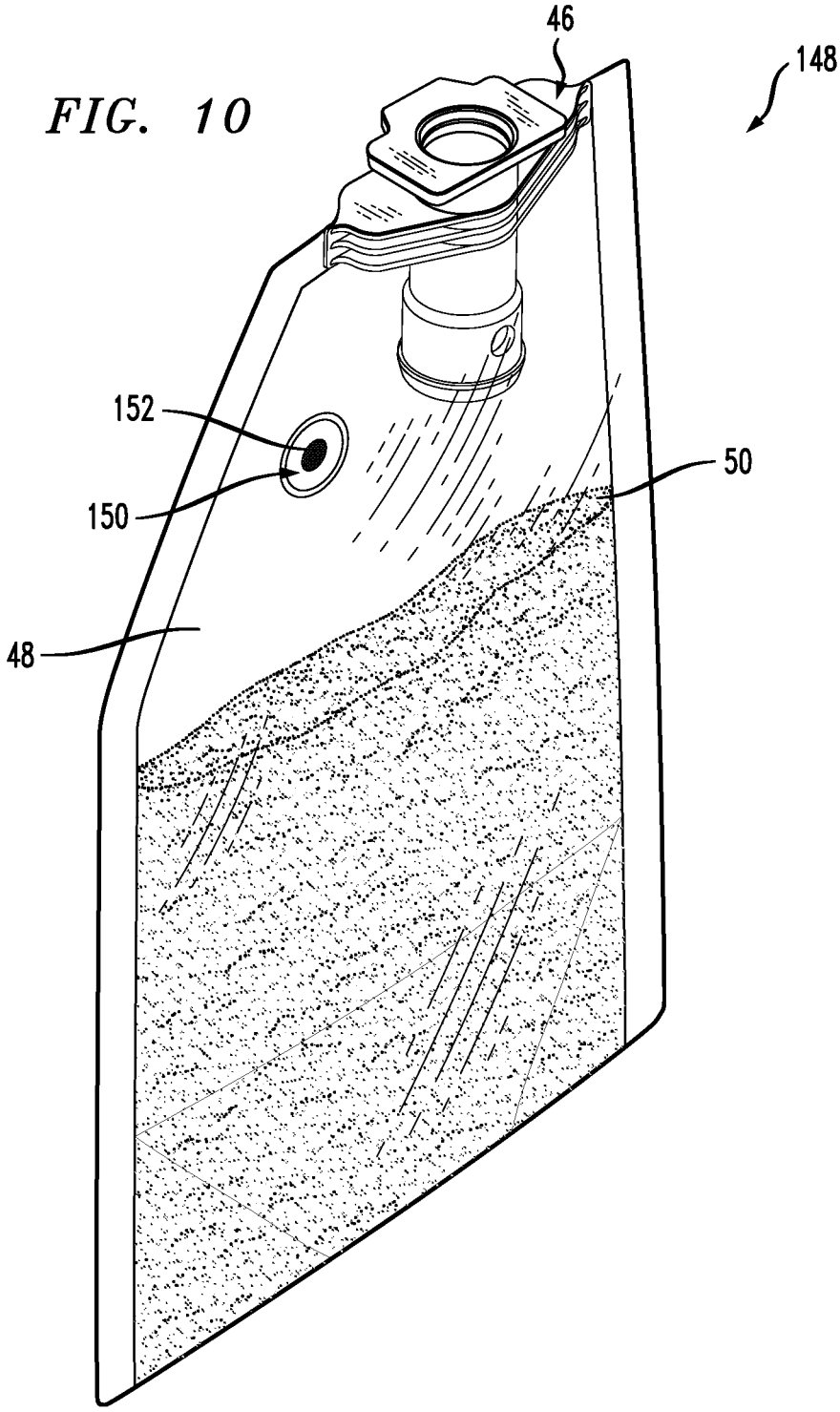
FIG. 10 is an elevational view of a fluid pouch with a gas vent having a gas permeable membrane for another embodiment of the present invention.

Referring to FIG. 10, a pouch 148 is shown for an alternative embodiment of the present invention. The pouch 148 is structurally similar to the pouch 34 of the previous embodiment. The pouch 148 includes a gas vent 150 disposed through the sidewall 48, and a gas permeable membrane 152 sealed across the vent 150 to permit passage of gas and vapors, while preventing passage of liquid therethrough. The gas permeable membrane may be made from the same material described previously in connection with the gas permeable membrane 126.

EXAMPLES

Example 1

A formulation of a stain cleaning fluid for one embodiment of the present invention is shown in the following table below.

TABLE 1

| Component | Amount (wt %) |
|---|---|
| 1) Isopropanol | 2.40 |
| 2) Tripropylene Glycol n-Butyl Ether | 9.60 |
| 3) Ethoxylated alcohol ($C_{10-14}$) | 0.59 |
| 4) Sodium bicarbonate (USP Grade #3) | 1.00 |
| 5) Sodium lauryl sulfate (29%) | 10.00 |
| 6) Fragrance | 0.40 |
| 7) Sodium Hydroxide 50% | 0.35 |
| 8) D.I. Water | 75.66 |

Example 2

A formulation of a stain cleaning fluid for another embodiment of the present invention is shown in the following table below.

TABLE 2

| Component | Amount (wt %) |
|---|---|
| 1) D.I. Water | 78.58 |
| 2) Hydrogen Peroxide (35%) | 21.42 |

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A portable, hand-holdable surface treating device, comprising:

a housing having a base, an upper portion, and opposed end portions;

a handle portion disposed centrally along the length of said housing upper portion, said handle portion comprising a gripping member for gripping by the user between said end portions;

a surface treating member being movably attached to the housing base proximate one of said end portions, said surface treating member being adapted for engaging a surface to be treated;

a driver operatively associated with the surface treating member, said driver being adapted for imparting a linear reciprocating motion to the surface treating member, wherein the surface treating member engages the surface to be treated in a manner substantially perpendicular to the surface to be treated; and said base being configured to properly orient the reciprocating motion of said surface treating member relative to the surface being treated when the base is in contact with the surface to be treated.

2. The surface treating device of claim 1 further comprising:

a dispenser for delivering a fluid, drawn directly from a discrete fluid source, to the surface being treated.

3. The surface treating device of claim 2 wherein the dispenser is configured to deliver the fluid at an angle of from about 40° to 80° from horizontal with the base in contact with the surface.

4. The surface treating device of claim 3 wherein the angle is from about 30° to 70° .

5. The surface treating device of claim 4 wherein the angle is about 60° .

6. The surface treating device of claim 1 wherein the surface treating member includes a distal end portion normally extending a distance below the base.

7. The surface treating device of claim 6 wherein the distance is at least 1 mm.

8. The surface treating device of claim 7 wherein the distance is from about 1 mm to 10 mm.

9. The surface treating device of claim 1 wherein the surface treating member is movably attached to the base via a spring mechanism.

10. The surface treating device of claim 9 wherein the spring mechanism is a cantilever-type spring.

11. The surface treating device of claim 9 wherein the spring mechanism includes a spring rate of at least 100 N/m.

12. The surface treating device of claim 11 wherein the spring rate is from about 100 N/m to 3,000 N/m.

13. The surface treating device of claim 12 wherein the spring rate is from about 600 N/m to 1,600 N/m.

14. The surface treating device of claim 1 wherein the surface treating member reciprocates at a rate of at least 1,000 Hz.

15. The surface treating device of claim 14 wherein the reciprocation rate of the surface treating member is from about 1,000 Hz to 15,000 Hz.

16. The surface treating device of claim 15 wherein the reciprocation rate of the surface treating member is from about 5,500 Hz to 7,000 Hz.

17. The surface treating device of claim 1 wherein the surface treating member comprises a plurality of bristles for engaging the surface to be treated.

18. The surface treating device of claim 1 wherein said driver comprises a motor operatively engaged to the surface treating member.

19. The surface treating device of claim 18 wherein the motor comprises a drive shaft and an unbalanced weight coupled to the drive shaft.

20. The surface treating device of claim 1 wherein the discrete fluid source is adapted to hold a solution comprising bicarbonate and peroxide.

21. The surface treating device of claim 1 comprising a plurality of discrete fluid sources and means for mixing fluids contained within said fluid sources to form a combined fluid.

22. The surface treating device of claim 21 wherein the dispenser comprises:

a pump for drawing the fluids from the plurality of discrete fluid sources; and a manifold comprising at least two inlets for receiving and combining the fluid from the plurality of discrete fluid sources to form the combined fluid.

23. The surface treating device of claim 22 further comprises a check valve associated with each discrete fluid source to prevent backflow of the fluid from the manifold.

24. The surface treating device of claim 22 wherein the pump is a manually operated pump.

25. The surface treating device of claim 22 wherein the dispenser is adapted to receive a bicarbonate solution from one discrete fluid source, and a peroxide solution from another discrete fluid source.

26. The surface treating device of claim 1 wherein the fluid sources each comprise a pouch.

27. The surface treating device of claim 26 wherein the pouch comprises a vent having a gas permeable membrane sealed thereacross for permitting a gas to pass from the pouch while at least substantially preventing passage of a liquid therethrough.

28. The surface treating device of claim 26 wherein the pouch further comprises a fitment in fluid communication with the fluid in the pouch, for facilitating reversible fluid coupling with said dispenser.

29. The surface treating device of claim 28 wherein the fitment further comprises a check valve.

30. The surface treating device of claim 28 wherein the fitment further comprises a throughhole providing fluid communication between the interior of the pouch and ambient, said throughhole being dimensionally configured to permit a gas to pass from the pouch while at least substantially preventing passage of a liquid therethrough.

31. The surface treating device of claim 26 wherein the pouch further comprises a tubular body extending outwardly from the pouch, said tubular body including a distal laterally inclined opening, and a gas permeable membrane sealing said distal laterally inclined opening.

32. A portable, hand-holdable surface treating device, comprising:

a housing having a base, an upper portion, and opposed end portions;

a handle portion disposed centrally along the length of said housing upper portion and comprising a gripping member for gripping by the user between said end portions;

a surface treating member being movably attached to the housing base proximate one of said end portions, said surface treating member having a plurality of bristles adapted for engaging a surface to be treated;

a driver operatively associated with the surface treating member, said driver being adapted for imparting a linear reciprocating motion to the surface treating member, wherein the bristles engage the surface to be treated in a manner substantially perpendicular to the surface to be treated; and said base being configured to properly orient the reciprocating motion of said surface treating member relative to the surface being treated when the base is in contact with the surface to be treated.

* * * * *